United States Patent [19]

Wehr

[11] Patent Number: 4,483,516

[45] Date of Patent: Nov. 20, 1984

[54] BAND-TENSIONING DEVICE

[75] Inventor: Hubert Wehr, Bornheim, Fed. Rep. of Germany

[73] Assignee: Cyklop International Emil Hoffmann, KG, Fed. Rep. of Germany

[21] Appl. No.: 376,577

[22] Filed: May 10, 1982

[30] Foreign Application Priority Data

May 12, 1981 [DE] Fed. Rep. of Germany ..... 3118711

[51] Int. Cl.[3] ..... B65B 13/22; B21F 9/02

[52] U.S. Cl. ..... 254/199; 24/68 D; 140/93.2

[58] Field of Search ..... 254/199, 216, 250, 251, 254/213; 140/93.2, 93.4, 123.5, 123.6; 100/32; 24/68 A, 68 D, 69 TM, 19, 273; 226/89, 90, 154, 155

[56] References Cited

U.S. PATENT DOCUMENTS 3,587,961 6/1971 Ritter ..... 226/90

FOREIGN PATENT DOCUMENTS 506266 9/1930 Fed. Rep. of Germany ..... 254/199
1023120 3/1966 United Kingdom ..... 254/216
1289393 9/1972 United Kingdom ..... 254/199
1357480 6/1974 United Kingdom ..... 254/213
2041869 9/1980 United Kingdom ..... 254/216
2059010 4/1981 United Kingdom ..... 254/199

*Primary Examiner*—Stuart S. Levy
*Assistant Examiner*—Katherine Jaekel
*Attorney, Agent, or Firm*—Lipton & Famiglio

[57] ABSTRACT

A band-tensioning device is disclosed which includes an operating lever rotationally fast with an eccentric which is pivotable about a fixed axis. An angle lever is provided which is freely pivotable about the eccentric, and urgeable to rotate therewith by means of the operating lever. A lower portion of the angle lever has an abutment surface which can cooperate with the friction surface of a rotatable tensioning wheel to force a band to be tensioned against the rotating wheel. The pivoting of the eccentric relative to the angle lever displaces it transversely to the abutment surface, so that the surfaces become separated and thus disengaged without having to overcome the high wedging forces associated with the tensioned band between the surfaces. The levers may be coupled by means other than the eccentric, e.g., via an articulated lever, provided the angle lever is selectively movable pivotally or transversely to the abutment surface.

9 Claims, 1 Drawing Figure

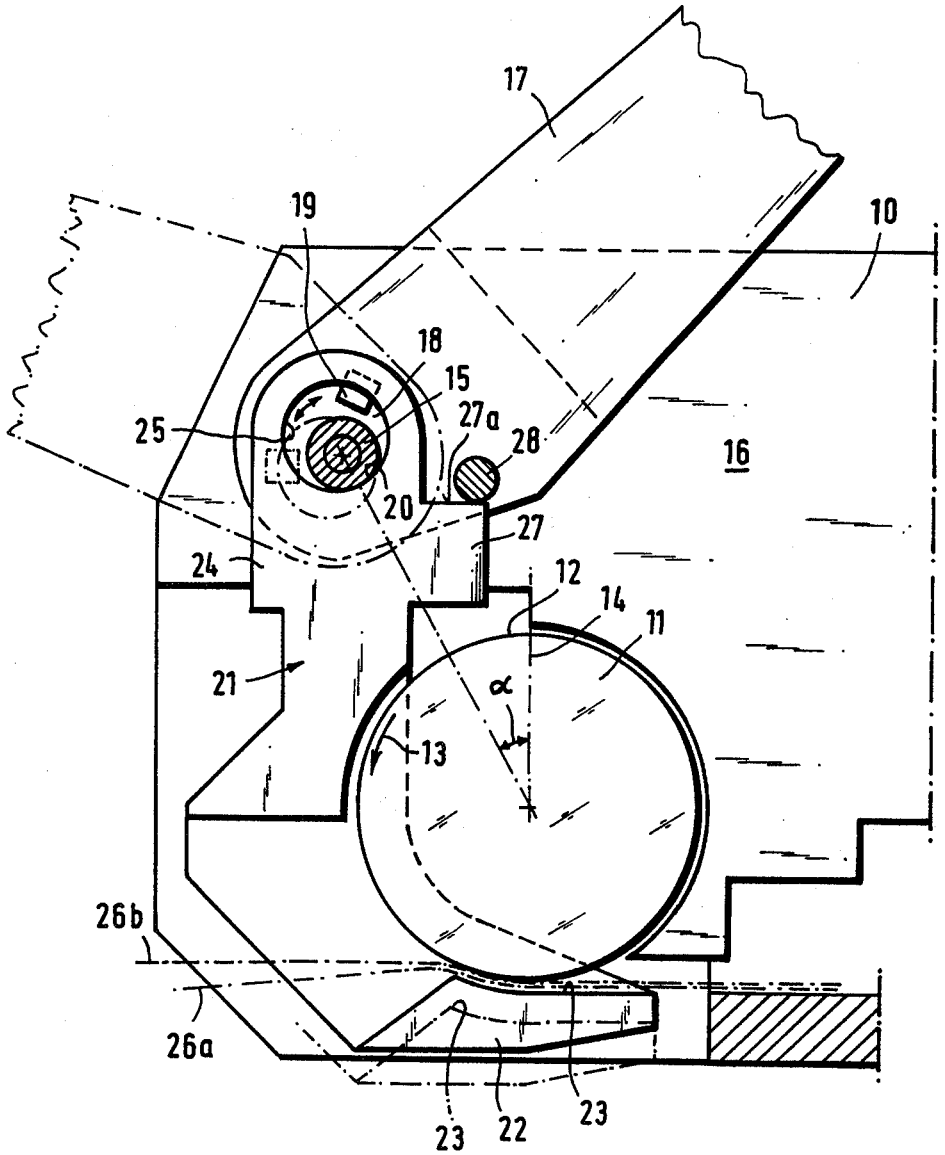
17
19
10
18
15
27a
25
28
16
20
27
24
12
14
11
21
α
13
26b
26a
23
22
23

BAND-TENSIONING DEVICE

BACKGROUND OF THE INVENTION

This invention relates to a tensioning device for a band, particularly a band made of plastic material such as postal strapping and the like.

Tensioning devices of this type known in the prior art have a rotary tensioning wheel which cooperates with an abutment plate which is pivotable relative to the tensioning wheel by a lever. Thus at least one of the two end portions of a band can be pressed against the tensioning wheel, which frictionally engages that end and draws it along the surface of the abutment plate, thus tensioning it. The lever has a handle at one end and the abutment plate at the other. By depressing the handle, the lever can be pivoted so that the abutment moves away from the tensioning wheel and band ends located between them are exposed and can be extracted.

In order to obtain a sufficiently high contact pressure during tensioning, the wedge angle between the tensioning wheel and the pivot axis of the lever is made as small as possible. Then, when the high band tension which is necessary of securing a band around a parcel is attained, there are extremely high forces between the abutment plate and the tensioning wheel, so that it is difficult to move the handle of the lever to release the abutment plate from the band ends clamped between it and the tensioning wheel.

SUMMARY OF THE INVENTION

The present invention includes a rotatable tensioning wheel having a surface which can frictionally engage a portion of a band which is to be tensioned.

An abutment plate is provided which is adapted to be pressed against the surface of the wheel.

A movable lever is connected to a coupling means so that movement of the lever causes movement of the abutment plate relative to the wheel. This causes the abutment surface to force a band against the surface of the tensioning wheel so that it frictionally engages the band. Rotation of the wheel thereby tends to draw the band along with it, placing it in tension. The abutment plate is movable relative to the wheel transverse to the abutment surface.

In the preferred embodiments of the present invention, the abutment plate can be released from the tensioning wheel, after the band ends have been tensioned, without applying a powerful force, and only a slight lever movement is necessary to open the band channel between the tensioning wheel and abutment surface for inserting the band ends into the apparatus. This is made possible due to the abutment surface being movably connected to the lever. The movement takes place in a direction generally transverse to the abutment surface relative to the tensioning wheel.

Such a design has the advantage that after the band ends have been tensioned the abutment surface can be released easily from the tensioning wheel. This is due to the fact that the wedging forces applied to the band ends do not have to be overcome when moving the surface of the abutment plate transversely with respect to the periphery of the tensioning wheel.

It is preferred to permit the abutment plate to pivot so that the lever can be used to pivot the abutment surface away from the tensioning wheel. Hence, for further sealing operations band ends can be easily inserted into the gap between the wheel and the abutment surface. In this form, the abutment surface is connected to a member which is also connected to the lever by an eccentric which is mounted rotatably on a fixed axis. In order to permit this member to also be pivoted away from the tensioning wheel, a stop which is mounted on the lever abuts a counter-surface on the member.

This member may conveniently be an angle lever, one arm of which provides the abutment surface and the other arm of which is mounted for rotation on the eccentric. The eccentric is rigidly connected to the operating lever. In this case the counter-surface may be provided on a projection of the member.

Further desirable features, objects and advantages of the present invention will be apparent from the following detailed description and accompanying drawing of one preferred embodiment of the invention.

BRIEF DESCRIPTION OF THE DRAWING

The sole drawing shows an embodiment of the tensioning device according to the invention in a vertical partial longitudinal section.

DESCRIPTION OF THE PREFERRED EMBODIMENT

A housing 10 of a tensioning and sealing apparatus for parcel hoops has a tensioning wheel 11 rotatably mounted in a lower region. The wheel 11 has a toothed or milled peripheral surface 12 and is driven in the direction of the arrow 13 by a drive motor, not shown in detail here. Above the tensioning wheel 11, and offset at a wedge angle $\alpha$ with reference to the vertical transverse plane 14 passing through the tensioning wheel, there is a transversely oriented pivot 15. This is mounted to the housing 10, extending between the two lateral walls 16 thereof, only one of which is shown.

An operating lever 17 with an eccentric 18 is mounted rotatably on this pivot 15. The operating lever 17 is forked at its lower end, the two fork arms being mounted on the pivot 15. Only the rear fork arm is visible in the drawing. The eccentric 18 is connected to the lever 17 non-rotatably by a key 19. It is journalled with its eccentrically arranged bearing aperture 20 on the pivot 15.

An angled member 21 has at a lower region an upwardly-facing abutment surface 23. This surface is curved correspondingly to the peripheral surface 12 of the tensioning wheel 11, so that it can press two mutually superposed end portions **26*a* and 26*b* of a band to be tensioned towards the tensioning wheel 11. At its upper region the member 21 has a circular aperture 25 which embraces the eccentric 18** so as to allow relative rotation.

The angled member 21 is so configured and arranged as partly to embrace the wheel 11. At an upper region it has an inwardly projecting portion 27, which can be abutted by a stop 28 which projects transversely from the operating lever 17.

When the apparatus has the configuration illustrated in solid lines in the drawing, by pivoting the lever 17 clockwise with the stop 28 abutting the projecting portion 27, force can be exerted upon the member 21. The abutment surface 23 is thereby pivotable counter to the action of a spring, (not shown) away from the tensioning wheel 11. Then, end portions **26*a* and 26*b* of a band 26 are inserted from the side into the band channel which is formed between tensioning wheel 11 and abutment surface 23**.

When the lever 17 is released, the above-mentioned spring pivots the angled member 21 back counterclockwise and urges the abutment surface 23 and the band ends 26*a* and 26*b* resting upon it against the periphery 12 of the tensioning wheel 11.

The drive means, not shown, for the tensioning wheel 11 is then switched on, so that it rotates in the direction of the arrow 13 and grips the upper band end 26*b*, which is caused to slide so that the band is tensioned. The contact pressure of the abutment surface 23 against the tensioning wheel 11 now increases automatically with increasing band tension, due to the wedging action produced due to the relative configuration of the pivot 15 of the angled member and the axis of rotation of the tensioning wheel 11. This occurs because the band end portion 26*b* sliding over the abutment surface 23 during tensioning tends to move the abutment surface 23 with it, and thus to pivot the angled member 21 counterclockwise abut the pivot 15.

When the desired band tension has been attained and the tensioning wheel 11 has come to a standstill, the band portions are mutally connected by means not shown here, and severed from the band supply. Then, in order to remove the band from the tensioning device the lever 17 and eccentric 18 are pivoted counterclockwise forcing member 21 into the position illustrated by chain-dotted lines. The movement of the eccentric 18 causes the angled member 21 to move downward and slightly to the left. The eccentric 18 and the member 21 with the abutment surface 23 on its lower arm 22 attain their positions shown in phantom, in which the band channel between abutment surface 23 and tensioning wheel 11 is open and the band 26 can thereby be extracted from the apparatus without difficulty.

It will be seen that due to the favorable lever ratio between the operating lever 17 and the member 21, which are mutually coupled by the eccentric 18, only a slight force on the lever 17 is necessary in order to release the abutment surface 23 from the tensioning wheel 11. In order to insert a fresh band, only a small clockwise movement of the lever 17 is necessary so that no force is applied to the abutment surface 23.

While the invention has been described with reference to a preferred embodiment, it will be understood by those skilled in the art that various changes are possible without department from the scope and spirit of the invention, and it is intended to cover all such changes and modifications encompassed by the appended claims. For example, instead of the eccentric 18, an articulate lever connection could be arranged between the operating lever 17 and the member 21, preferably so as to give similar force ratios.

What is claimed is:

1. A band tensioning device comprising:

a rotatable tensioning wheel having a surface adapted to engage frictionally a portion of a band to be tensioned;

abutment means including an angle lever having first and second arms said first arm having an abutment surface adapted to cooperate with said surface of the wheel;

a movable lever; and coupling means including a rotatable eccentric mounted to the device and to said lever adapted to engage said second arm of said abutment means for coupling said movable lever and abutment means so that said movable lever is movable to effect movement of the abutment means relative to the wheel, said movement being effectable to cause the abutment surface to urge a band against said surface of the tensioning wheel to be frictionally engaged therby so that rotation of the wheel tends to draw the band along with it, so as to place it in tension; said abutment means being movable relative to the wheel transversely to the abutment surface.

2. A band tensioning device comprising:

a rotatable tensioning wheel having a surface adapted to engage frictionally a portion of a band to be tensioned;

abutment means having an abutment surface adapted to cooperate with said surface of the wheel;

a movable lever pivotally connected to the device having an abutment member adapted to engage the abutment surface of said abutment means; and coupling means for coupling said lever and abutment means so that said movable lever is movable to effect movement of the abutment means relative to the wheel, said movement being effectable to cause the abutment surface to urge a band against said surface of the tensioning wheel to be frictionally engaged thereby so that rotation of the wheel tends to draw the band along with it, so as to place it in tension; said abutment means being movable relative to the wheel transversely to the abutment surface.

3. A device according to claim 2 wherein said abutment member of said movable lever comprises a stop rigidly connected to the movable lever which engages a projecting portion of the abutment means.

4. A device according to claims 1, 2 or 3 wherein, the coupling means includes means responsive to rotation of said movable lever for causing said abutment means to substantially move in a radial direction away from said wheel followed by tangential movement with respect to said wheel subsequent to tensioning of said band, thereby permitting the band to be removed from the device.

5. A band tensioning device comprising:

a rotatable tensioning wheel having a surface adapted to engage frictionally a portion of a band to be tensioned;

abutment means having an abutment surface adapted to cooperate with said surface of the wheel;

a movable lever;

coupling means for coupling said lever and abutment means so that said lever is movable to effect movement of the abutment means relative to the wheel, said movement being effectable to cause the abutment surface to urge a band against said surface of the tensioning wheel to be frictionally engaged thereby so that rotation of the wheel tends to draw the band along with it, so as to place it in tension; said abutment means being movable relative to the wheel transversely to the abutment surface; said coupling means including means responsive to rotation of said movable lever for causing said abutment means to substantially move in a radial direction away from said wheel followed by tangential movement with respect to said wheel, thereby permitting the band to be removed from the device.

6. A device according to claim 5 wherein said coupling means comprises a rotatable eccentric mounted with a fixed axis, and said abutment means is connected to said lever via said eccentric.

7. A device according to claim 6, wherein the abutment means comprises an angle lever having two arms, one of which provides the abutment surface while the other is mounted for free rotation on the eccentric, which is rotationally fast with the lever.

8. A device according to claim 5 wherein said movable lever and said abutment means have respective complementary abutment portions by engagement of which the lever is operable to pivot said abutment surface of the abutment means away from said tensioning wheel.

9. A device according to claim 8 wherein said complementary abutment portions comprise a stop rigidly connected to said movable lever and a projecting portion of the abutment means.

* * * * *